US005653433A

United States Patent [19]

Ishizuka

[11] Patent Number: 5,653,433

[45] Date of Patent: Aug. 5, 1997

[54] SHEET SUPPLY APPARATUS

[75] Inventor: Haruo Ishizuka, Kawasaki, Japan

[73] Assignee: Canon Kabushiki Kaisha, Tokyo, Japan

[21] Appl. No.: 392,339

[22] Filed: Feb. 22, 1995

[30] Foreign Application Priority Data

Feb. 23, 1994 [JP] Japan ..... 6-025334
Sep. 21, 1994 [JP] Japan ..... 6-226425

[51] Int. Cl.[6] ..... B65H 3/52
[52] U.S. Cl. ..... 271/121; 271/124; 271/167
[58] Field of Search ..... 271/121, 124, 271/167

[56] References Cited

U.S. PATENT DOCUMENTS 4,887,806 12/1989 Tanaka et al. ..... 271/121
4,915,372 4/1990 Kano et al. ..... 271/121
4,995,601 2/1991 Chashi et al. ..... 271/127
5,083,766 1/1992 Osawa ..... 271/121
5,104,113 4/1992 Kameyama et al. ..... 271/124
5,183,248 2/1993 Okada et al. ..... 271/121
5,261,652 11/1993 Kubo ..... 271/121
5,277,417 1/1994 Moritake et al. ..... 271/121
5,377,970 1/1995 Kikuchi ..... 271/121

FOREIGN PATENT DOCUMENTS 47233 2/1988 Japan ..... 271/121
288536 11/1989 Japan ..... 271/121
3-12755 2/1991 Japan .

*Primary Examiner*—Karen B. Merritt
*Assistant Examiner*—Douglas Hess
*Attorney, Agent, or Firm*—Fitzpatrick, Cella, Harper & Scinto

[57] ABSTRACT

The present invention provides a sheet supply apparatus with a sheet stacking plate for stacking and supporting sheets, a supply rotary member for feeding out the sheets stacked on the sheet stacking plate, and a preventing device biased toward the supply rotary member and adapted to prevent double-feed of sheets. The preventing device has a lower central portion and high end portion along an axial direction of the supply rotary member.

25 Claims, 10 Drawing Sheets

SHEET SUPPLY APPARATUS

BACKGROUND OF THE INVENTION

1. Field of the Invention

The present invention relates to a sheet supply apparatus for supplying a sheet (recording sheet, original sheet or the like) in an image forming apparatus such as a facsimile, a copying machine, a printer and the like.

2. Related Background Art

In the past, there has been proposed a sheet supply apparatus for supplying a recording sheet in a facsimile machine and the like, wherein the sheets are separated one by one by a sheet supply roller and a double-feed preventing member (separation pad) urged against the sheet supply roller. In such a separating mechanism, when certain kinds of sheets are used, vibration and noise may be generated between the sheet supply roller and the separation pad. To prevent such noise, there has been proposed a mechanism in which a separation pad has two rubber layers, for example, as disclosed in the Japanese Utility Model Publication No. 3-12755.

This mechanism has a laminated-structure friction pad comprising a friction layer made of urethane rubber, and a buffer layer made of elastic material softer than the urethane rubber. The sheets are separated by the friction layer and the vibration is suppressed by the buffer layer, thereby preventing the noise.

However, in the above-mentioned conventional separating mechanism, since the two-layer friction pad is constituted by the two rubber layers bonded together by an adhesive, the manufacturing cost is increased. Further, since the buffer layer is made of softer elastic material such as foam rubber, foam polyurethane, polyurethane foam or the like, after the separation pad was used for a long time, the elasticity of the buffer layer is worsened to cause the plastic or permanent deformation. If the permanent deformation occurs, pressure (separation pressure) between the sheet supply roller and the friction layer is decreased and/or a contacting condition between the sheet supply roller and the friction layer is changed from the initial condition, thereby worsening the sheet separating ability.

SUMMARY OF THE INVENTION

An object of the present invention is to provide a sheet supply apparatus in which a sheet separating ability is not worsened even when the apparatus is used for a long time, and the occurrence of noise can surely be prevented.

Another object of the present invention is to provide a sheet supply apparatus which is simple in construction and inexpensive.

To achieve the above objects, according to one aspect of the present invention, there is provided a sheet supply apparatus comprising a sheet stacking plate for stacking and supporting sheets, a supply rotary member for feeding out the sheets supported by the sheet stacking plate, and a double-feed preventing means biased toward the supply rotary member to prevent the double-feed of the sheets. Wherein the double-feed preventing means has a lower central portion and higher end portions along an axial direction of the supply rotary member.

According to another aspect of the present invention, there is provided a sheet supply apparatus comprising a sheet stacking plate for stacking and supporting sheets, a supply rotary member for feeding out the sheets supported by the sheet stacking plate, and a double-feed preventing means biased toward the supply rotary member to prevent the double-feed of the sheets. Wherein the double-feed preventing means has a preventing surface for preventing movement of the sheets, and the preventing surface has a curved configuration having a lower central portion and higher end portions along an axial direction of the supply rotary member.

According to a further aspect of the invention, there is provided a sheet supply apparatus comprising a sheet stacking plate for stacking and supporting sheets, a supply rotary member for feeding out the sheets supported by the sheet stacking plate, and a double-feed preventing means biased toward the supply rotary member to prevent the double-feed of the sheets. Wherein the double-feed preventing means has a preventing surface for preventing movement of the sheets, which preventing surface has outboard portions extending outwardly of the supply rotary member in an axial direction of the supply rotary member, and the outboard portions are higher than the preventing surface toward the supply rotary member.

According to a still further aspect of the present invention, there is provided a sheet supply apparatus comprising a sheet stacking plate for stacking and supporting sheets, a supply rotary member for feeding out the sheets supported by the sheet stacking plate, and a double-feed preventing means biased toward the supply rotary member to prevent the double-feed of the sheets. Wherein the sheets are bent between the double-feed preventing means and the supply rotary member to become convex toward the double-feed preventing means.

DETAILED DESCRIPTION OF THE PREFERRED EMBODIMENTS

Figure 5:
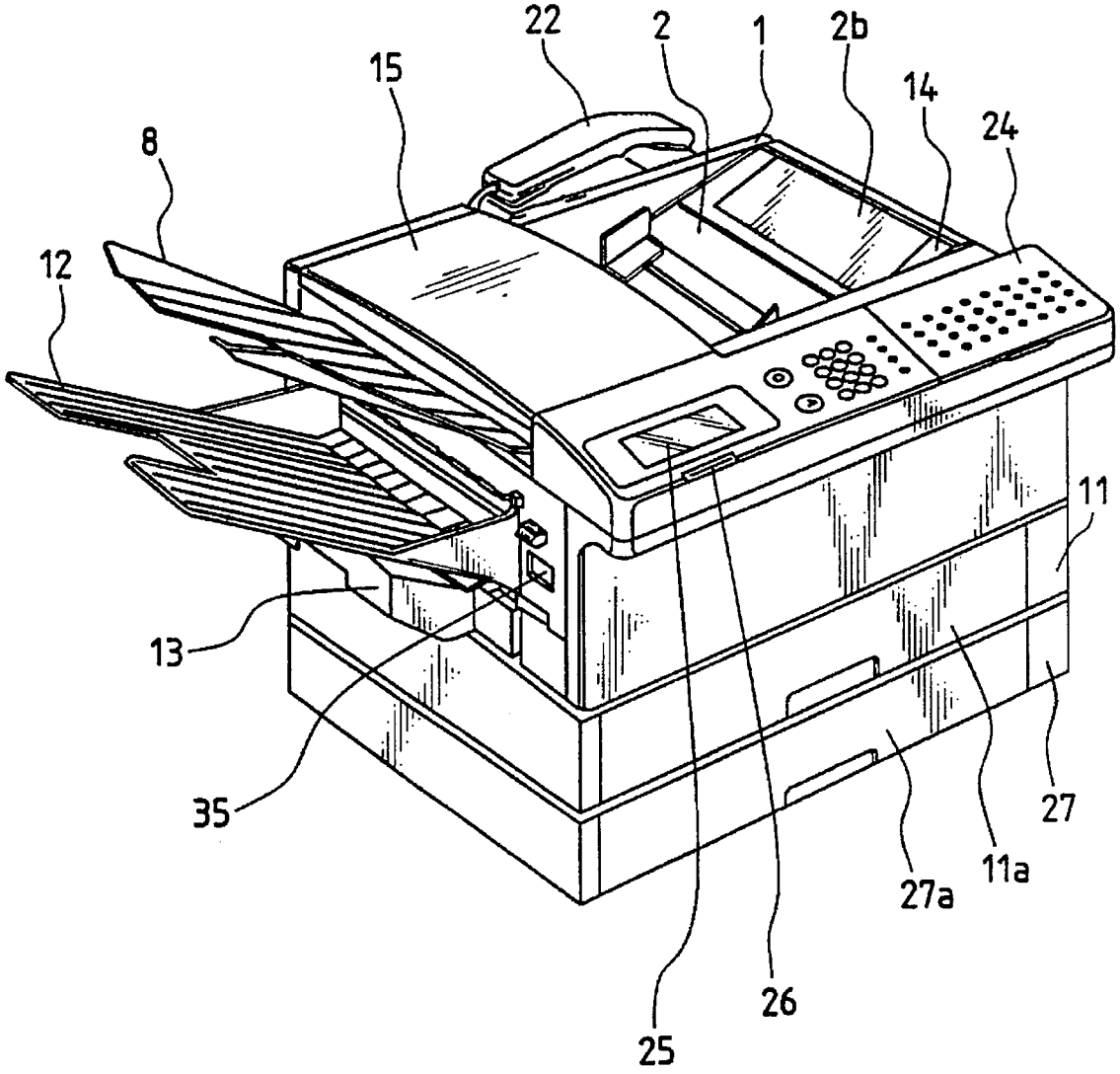
FIG. 5 is a perspective view of a facsimile system to which the present invention is applied.

First of all, the entire construction of a facsimile system having a sheet supply apparatus according to a first embodiment of the present invention will be briefly explained with reference to FIGS. 5 and 6.

The facsimile system comprises a body or frame 1, an original stacking plate 2 on which a plurality of originals D can be stacked, an image reading portion 3 for reading image information on the original D, a recording portion 4 comprised of a laser beam printer, an original conveying portion 5, an original urging portion 6, an image sensor 7 of contact type, an original discharge tray 8, a laser scanner 9, an image forming portion 10, a cassette sheet supply portion 11, a recording sheet discharge tray 12, an MP (multi recording sheet) cassette 13, a cartridge cover 14, an ADF (automatic document (original) feeder) cover 15, an upper original guide 16, a weight shaft 17, an original hold-down plate 18, a lower original guide 19, a partition portion 20 for separating the image reading portion and the recording portion, a control portion 21, a hand set 22, a convey guide 23, an operating portion 24, a display portion 25, a lamp 26 indicating an operating condition of the facsimile system, a second cassette portion 27, a light cover 28, an MP cassette sensor 29, and an MP separating portion 30.

In the image reading portion 3, the originals D stacked on the original stacking plate 2 are separated one by one by means of a re-convey roller 5*b*urged against a preliminary convey urging piece 5*a* and a separation roller 5*d* urged against a reverse rotation roller 5*c*, and the separated original is conveyed to the image sensor 7 of contact type by means of a sheet supply roller 5*f* against which a roller 5*e* is urged by an urging spring 5*k*. In the original urging portion 6, the original D is urged against the image sensor 7 of contact type by the weight shaft 17 and the original hold-down plate 18. After the image information on the original D is read by the image sensor 7, is discharged onto the original discharge tray 8 by a discharge roller 5*h* against which a roller 5*g* is urged by the urging spring 5*k*. Meanwhile, the original D is guided by the upper and lower original guides 16 and 19.

The original stacking plate 2 is provided with a slider 2*a* slidable in a direction (widthwise direction of the original D) perpendicular to an original conveying direction, so that both lateral edges of the originals D stacked on the original stacking plate 2 can be aligned with each other by shifting the slider 2*a*. Further, when elongated originals are used, by opening an original tray extension 2*b*, the rear end portions of the originals D are supported by the original tray extension, thereby preventing the rear end portions of the originals from depending downwardly.

In the recording portion 4, a modulated signal is generated from a laser beam generator 9*a* of the laser scanner 9 in response to image signal emitted from the control portion 21, and the modulated beam is illuminated onto a photosensitive drum 10*a* of the image forming portion 10 via a polygon mirror 9*b*, thereby forming an image corresponding to the image information on the surface of the photosensitive drum 10*a*. Thereafter, the image is transferred onto the recording sheet S supplied from the cassette sheet supply portion 11 or the second cassette portion 27 or the MP cassette portion 27. Then, the recording sheet to which the image was transferred is discharged onto the recording sheet discharge tray 12.

The photosensitive drum 10*a* is incorporated into a record cartridge 10*e* together with a first charger 10*b*, a developing roller 10*c* and a cleaning roller 10*d*, which recording cartridge can be removably be mounted to the frame 1 of the facsimile system. The surface of the photosensitive drum 10*a* is uniformly charged by the first charger 10*b*. When the scan light is illuminated onto the photosensitive drum by the polygon mirror 9*b* through a reflection mirror 9*c*, a latent image is formed on the photosensitive drum. The latent image is developed by toner supplied from the developing roller 10*c* to form a toner image.

A transfer charger 10*f* is disposed around the photosensitive drum 10*a* of the image forming portion 10, and a thermal fixing device 10*g* and discharge rollers 10*h* are disposed at a downstream side of the photosensitive drum 10*a* in a recording sheet conveying path. After the toner image formed on the photosensitive drum 10*a* is transferred onto the recording sheet S by the transfer charger 10*f*, the recording sheet is conveyed along the convey guide 23 to reach the thermal fixing device 10*g*, where the toner image is fixed to the recording sheet. Thereafter, the recording sheet is discharged onto the discharge tray 12 by the discharge rollers 10*h*.

The MP cassette portion 13 is provided at a bottom portion of the body 1 of the facsimile system. The recording sheet S stacked in an MP cassette 13*a* are urged against an MP separation roller 30*a* by rocking an MP intermediate plate 13*c* via an intermediate plate pressure arm 13*b* and are separated one by one by means of an MP separation pad 30*b* (friction piece separation fashion), and the separated recording sheet is conveyed along an MP separation base 30*c* and then is turned over by a convey roller 28*a*, a cover side U-turn guide 28*b* provided on the light cover 28, and a body side U-turn guide 28*c* provided on the body 1.

Further, the tip end of the recording sheet S being conveyed is detected by a resist sensor 28*d* so that the sheet supplying timing and the image output timing are adjusted to align the tip end of the toner image formed on the photosensitive drum 10*a* with the tip end of the recording sheet S. Then, the recording sheet is conveyed between the transfer charger 10*f* and the photosensitive drum 10*a*. The image is recorded on an lower surface of the recording sheet (when it is stacked in the MP cassette 13*a*).

Further, lateral edges and rear ends of the recording sheets S are regulated by an MP regulating plate 13*d* shiftable in dependence upon the size of the recording sheet to prevent the skew-feed and poor sheet supply. The size and presence/absence of the recording sheet S are detected by the MP cassette sensor 29. The maximum number of recording sheets which can be stacked in the MP cassette is 100, and the cassette can be retracted from the body 1 at a left side (side floating type). Further, the size of the recording sheet which can be used in this facsimile system is A4 size, LTR (letter) size and Legal size, and, in FIG. 6, the MP regulating plate 13*d* is set for the A4 size sheet.

The cassette sheet supply portion 11 is provided so that a top plate 11*h* is contacted with the bottom of the body 1, and the top plate 11*h* also acts as a bottom plate of the body 1. The recording sheets S stacked in a sheet supply cassette 11*a* are biased upwardly by urging an intermediate plate 11*e* upwardly by intermediate springs 11*f* and are separated one by one by a semi-circular sheet supply roller 11*b* and a pair of separation pawls 11*d* (pawl separation fashion), and the separated recording sheet S is conveyed by a pair of cassette convey rollers 11*c* to be passed between the MP separation base 30*c* and a sheet-pass guide 28*e*. Then, the recording sheet is turned over by the convey roller 28*a*, cover side U-turn guide 28*b* provided on the light cover 28, and body side U-turn guide 28*c* provided on the body 1.

The sheet path from the cassette sheet supply portion 11 is joined to the sheet path from the MP cassette portion 13 in front of the convey roller 28*a*. From this point, the recording sheet S from the cassette sheet supply portion 11 is conveyed in the same manner as the recording sheet from the MP cassette portion 13. The image is recorded on a lower surface of the recording sheet (when it is stacked in the sheet supply cassette 11*a*).

Figure 6:
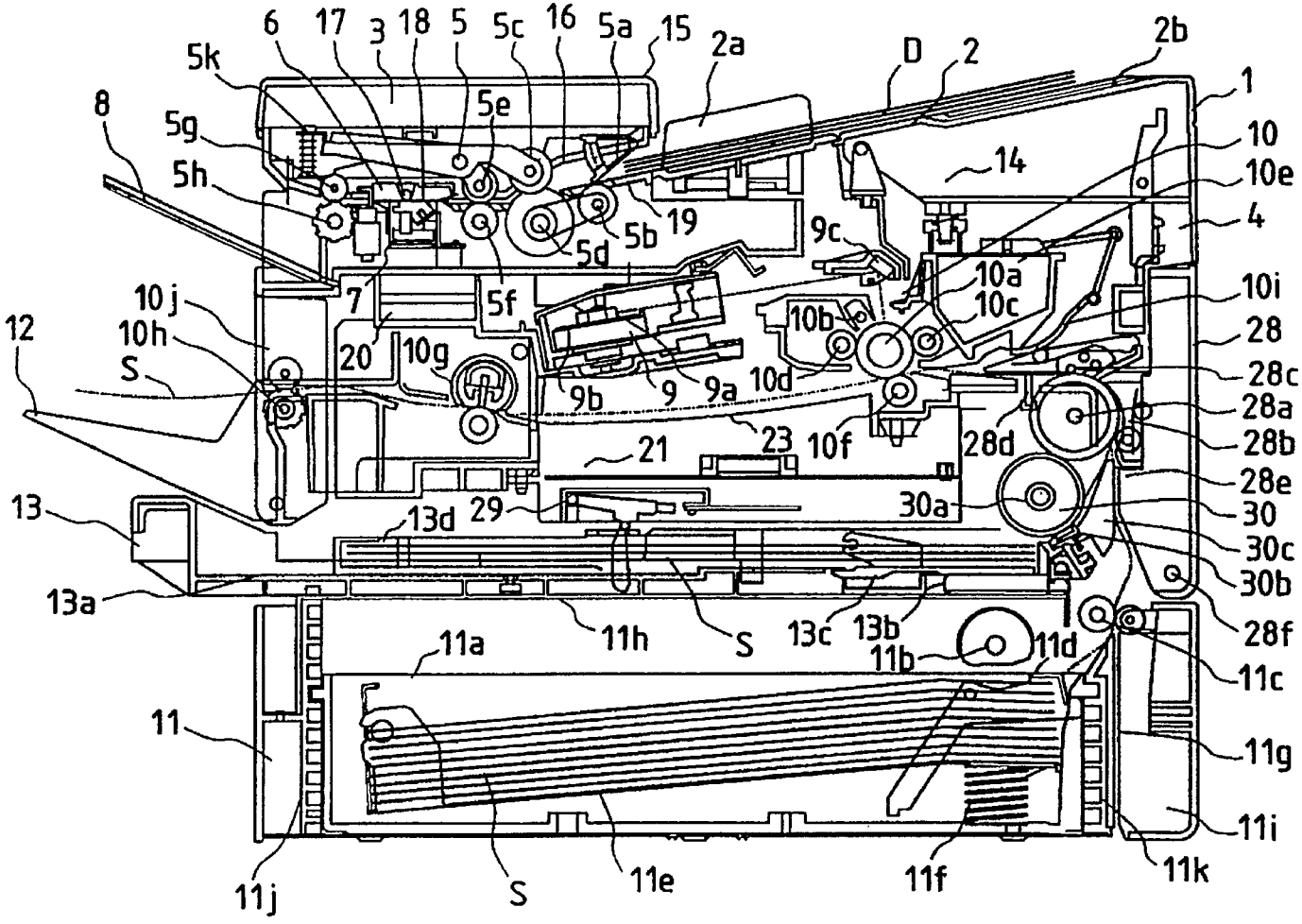
FIG. 6 is an elevational sectional view of the facsimile system.

Although not show in FIG. 6, the second cassette sheet supply portion 27 has substantially the same construction as the illustrated cassette sheet supply portion 11, and a recording sheet S in a second cassette is 27*a* supplied to the recording portion 4 through a space 11*g* formed at a side of the cassette sheet supply portion 11. The maximum numbers of recording sheets which can be stacked in the cassettes are 100, respectively, and the cassettes can be retracted from the body 1 at a front side (front floating type). The size of the recording sheets which can be used in the cassettes 11*a*, 27*a* is A4 size, and LTR (letter) size.

The cassette sheet supply portion 11 and the second cassette sheet supply portion 27 can be mounted to and dismounted from the facsimile system as option so that the maximum number of the recording sheets which can be used in the facsimile system can be varied from 100 to 1100.

When the cartridge cover 14 is opened with respect to the system body 1, a recording cartridge can be exchanged. Further, the cartridge cover 14 is provided with an interlock mechanism so that the operation of the recording portion 4 is prevented when the cartridge cover 14 is opened or the recording cartridge 10*e* is not mounted to the system body 1. A photo-sensitivity preventing shutter 10*i* provided on the recording cartridge 10*e* is operated in synchronous with the mountin movement of the recordin cartridge 10*e* to the system body 1 so that, when the cartridge cover 14 is opened and the recording cartridge 10*e* is mounted to the system body 1, the shutter 10*i* is opened, and, when the recording cartridge 10*e* is dismounted from the system body 1, the shutter 10*i* is closed to prevent the undesired photosensitivity of the photosensitive drum 10*a*.

If the recording sheet is jammed during the recording operation, by opening the cartridge cover 14, light cover 28, discharge cover 10*j* or jam releasing cover 1*i*, the jammed recording sheet S can be removed. Further, the discharge cover 10*j* can be opened only after the recording sheet discharge tray 12.

The partition portion 20 comprises a duct for 10 separating the image reading portion 3 and the recording portion 4. By lowing air through the duct by means of a fan (not shown), the image reading portion 3 is prevented from being affected a bad influence by heat generated at the recording portion 4, and the dewing of vapor vaporized from the recording sheet S is prevented, thereby preventing the water droplet from dropping onto the recording sheet S. In the image sensor 7 of contact type, light from an LED array (light source) is illuminated onto an imaged surface of the original, and the light reflected from the imaged surface is focused onto a sensor element through a SELFOC lens, thereby reading the image information.

Figure 1A:
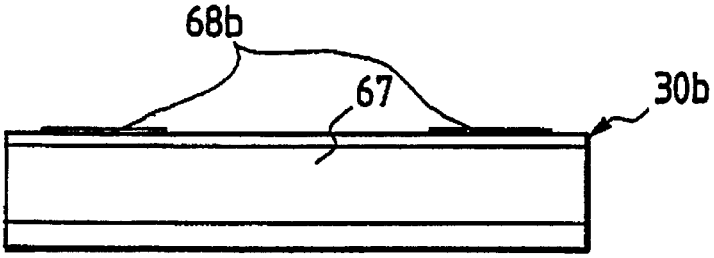
FIGS. 1A to 1C are views showing a separation pad of a sheet supply apparatus according to a preferred embodiment of the present invention used with a facsimile system.
Figure 1B:
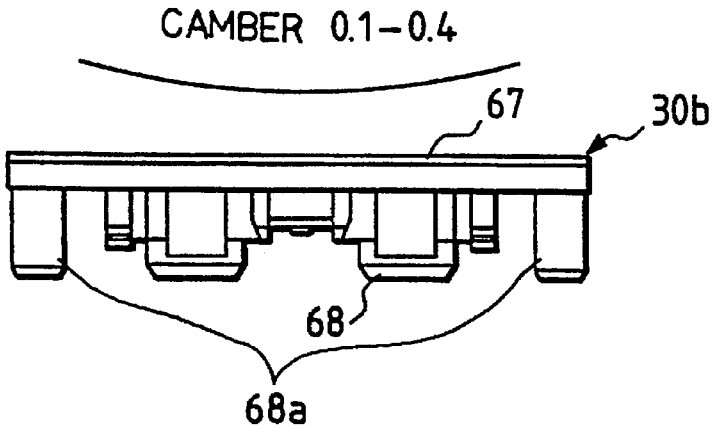
Figure 1C:
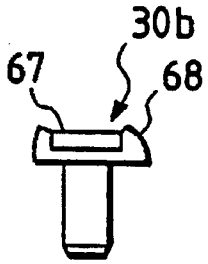
Figure 2:
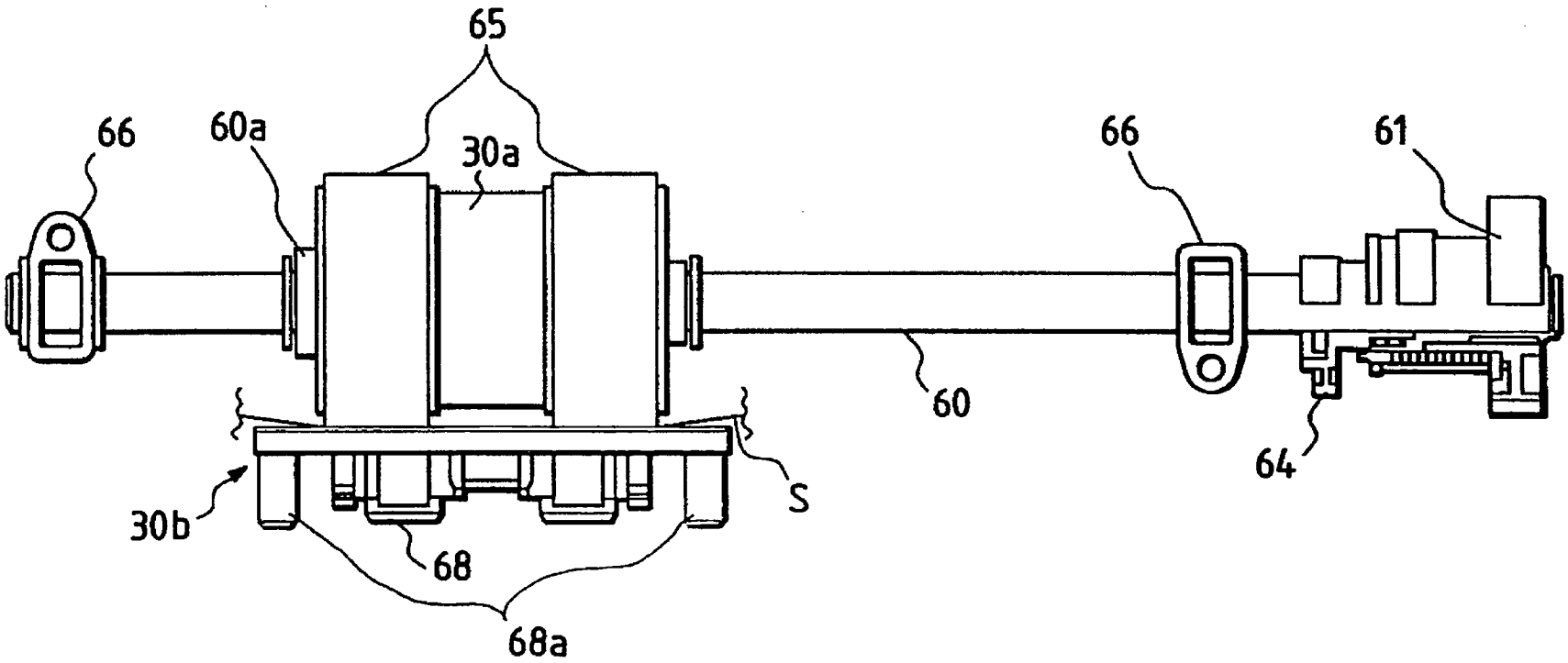
FIG. 2 is a front view of a separation roller and a separation pad, looked at from an upstream side of a sheet supplying direction.
Figure 3:
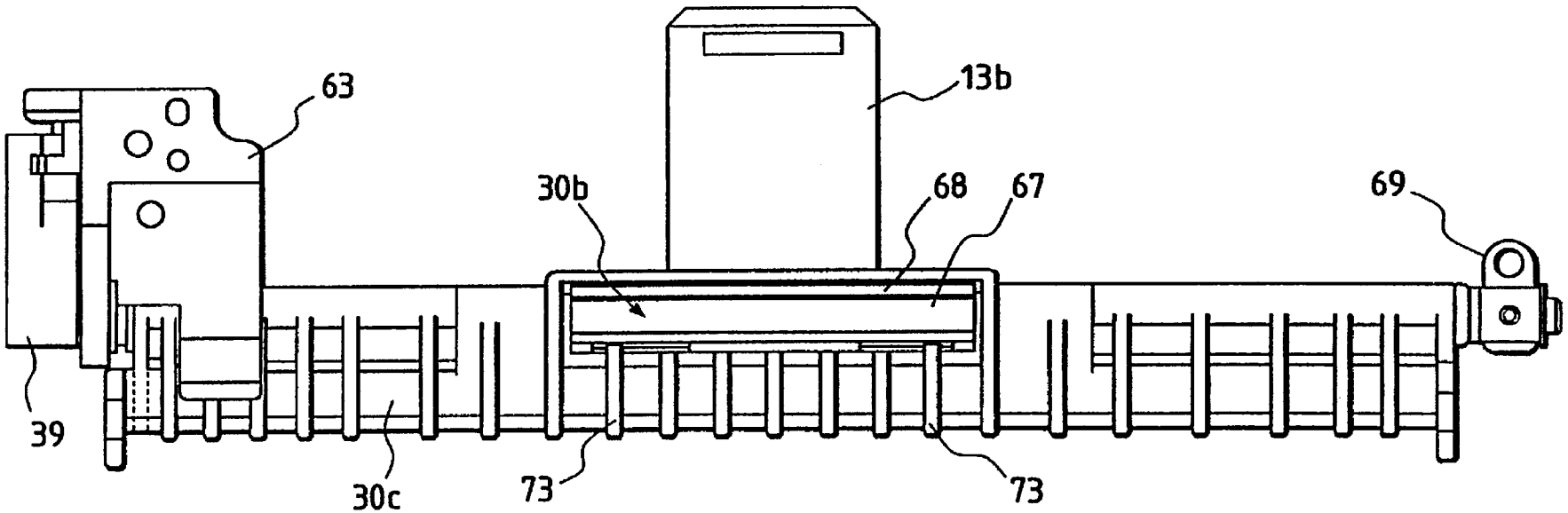
FIG. 3 is a plan view of a separation base.
Figure 4:
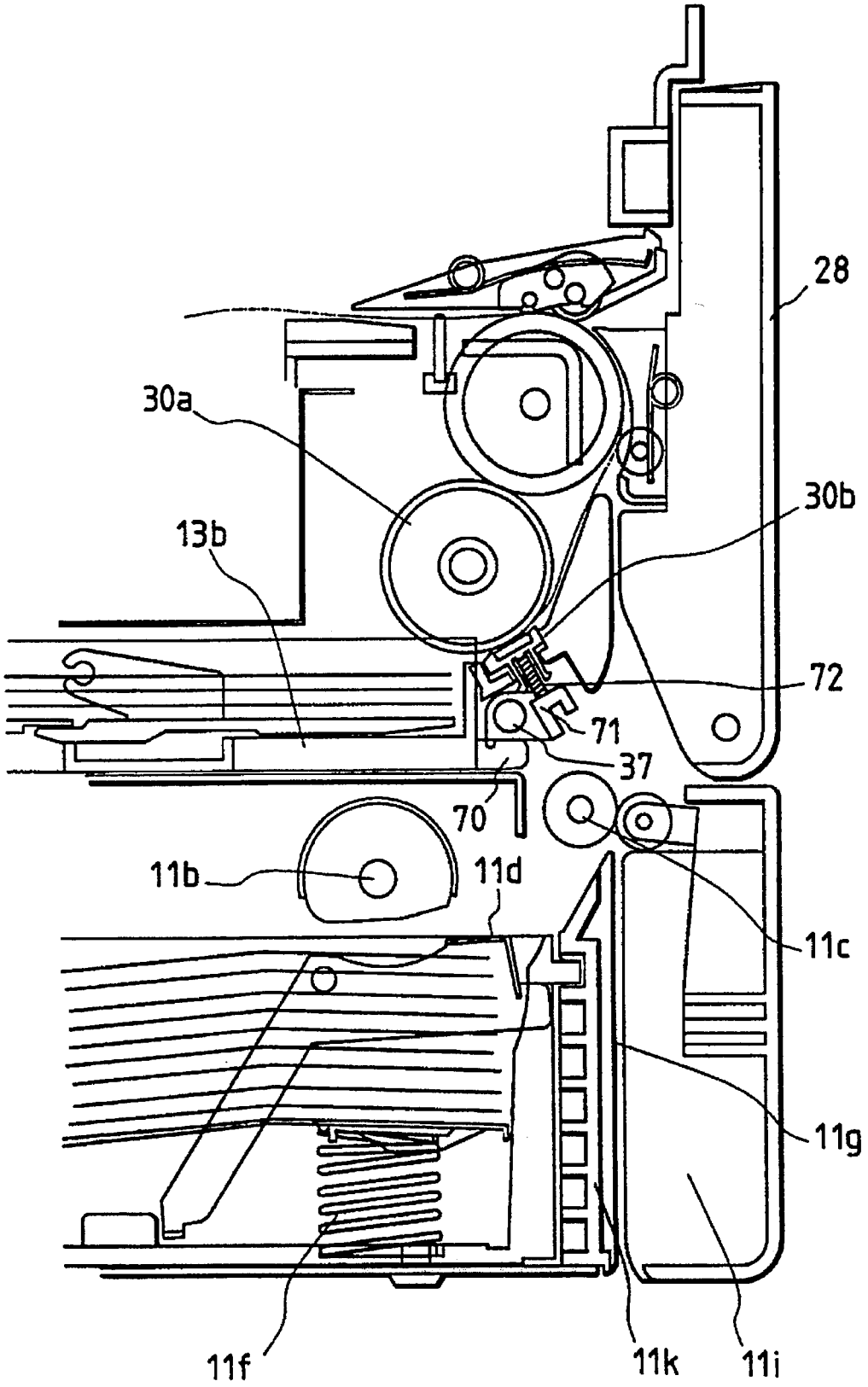
FIG. 4 is an enlarged view of a multi recording sheet (MP) separating portion.

Next, the MP separating portion will be explained with reference to FIGS. 1A to 1C and FIGS. 2 to 4. FIGS. 1A to 1C are views showing the separation pad 30*b*, FIG. 2 is a front view of the separation roller 30*a* and the separation pad 30*b*, looked at from an upstream side of the sheet supplying direction, FIG. 3 is a plan view of the separation base 30*c*, and FIG. 4 is an enlarged view of the multi recording sheet (MP) separating portion. In FIGS. 1A to 1C and FIGS. 2 to 4, the reference numeral 37 denotes a separation shaft; 13*b* denotes an intermediate plate pressure arm; 39 denotes an intermediate plate pressure lever; 30*a* denotes the MP separation roller; 61 denotes a one-way clutch unit; 63 denotes a bearing support; 64 denotes a separation cam; 65 denotes a separation rubber roller; 66 denotes bearings; 67 denotes a separation rubber pad; 68 denotes a separation pad holder; and 79 denotes a bearing for the separation shaft 37.

Next, the sheet supplying mechanism will be explained. An MP separation roller unit comprises the MP separation roller 30*a* secured to a drive shaft 60 at a central portion in a widthwise direction of the recording sheet, the one-way clutch unit 61 including the separation cam 64 fixed at the outside of the width of the recording sheet, and the bearings 66 for mounting the drive shaft 60 on a frame. The separation pad 30*b* is constituted by bonding the separation rubber pad 67 to the separation pad holder 68 by a both-face adhesive tape or an adhesive.

The intermediate plate pressure arm 13*b* is secured to the separation shaft 37 at a central portion in a widthwise direction of the recording sheet, and the intermediate plate pressure lever 39 is also secured to the separation shaft 37 in a confronting relation to the separation cam 64. The separation shaft 37 is supported by the frame via the bearing 59 and the bearing support 63. An intermediate pressure spring (not shown) connected between the intermediate plate pressure lever 39 and the bearing support 63 serves to bias the intermediate plate pressure arm 13*b* in a clockwise direction in FIG. 4.

In a waiting condition, a phase angle is so adjusted that, at a position where the intermediate plate pressure lever 39 is pushed downwardly by the separation cam 64, the one-way clutch unit 61 is idly rotated and the separation cam 64 is stopped. In the sheet supplying condition, under the control of a drive system (not shown) such as a solenoid, the one-way clutch unit 61 starts to transmit the driving force. When the MP separation roller 30*a* is rotated, the intermediate plate pressure arm 13*b* is rotated by the rotation of the intermediate plate pressure lever 39 along the separation cam 64, with the result that the MP intermediate plate 13*c* is biased upwardly and the sheet supplying pressure is generated by the biasing force of the intermediate pressure spring. When the separation cam 64 is further rotated, the intermediate plate pressure lever 39 is pushed downwardly along the separation cam 64, and, thus, the MP intermediate plate 13*c* is lowered by its own weight. When the separation cam is rotated by one revolution, the waiting condition is restored (one revolution sheet supply).

The separation pad 30*b* is biased toward the MP separation roller 30*a* by fixing a separation lever 71 at a predetermined position by a tip projection 70 of the MP cassette 13*a* and by compressing a separation spring 72, thereby generating a separating pressure. The separation spring 72 is attached to a separation spring attaching boss 68*c* (FIG. 7D) provided on the separation pad holder 68.

The double-feed of recording sheets is prevented by the MP separation roller 30*a* and the separation pad 30*b*. Further, after the driving operation, the MP separation roller 30*a* is idly rotated by a needle one-way clutch 60*a* incorporated into the MP separation roller 30*a*, thereby affecting no load.

Next, the separation pad 30*b* will be explained. FIG. 1A is a plan view of the separation pad 39*b*, FIG. 1B is a front view of the separation pad, and FIG. 1C is a side view of the separation pad. The rotation of the separation pad holder 68 is regulated bosses 68*a* and can be shifted along holes (not shown) formed in the separation base 30*c* in a direction perpendicular to an axis of the separation roller 30*a*.

Each boss 68*a* has cylindrical shape, and each hole is tapered to be gradually wide toward the separation pad 30*b*. The movement of the separation pad holder 68 toward a downstream side in the sheet supplying direction is regulated by the bosses 68*a* and projections 68*b* provided at a downstream side of the separation pad holder in such a manner that the projections 68*b* are abidingly contacted with two pad regulating ribs 73 of the separation base 30*c* at contact areas 74. A distance between two pad regulating ribs 73 is slightly greater than a length of the separation rubber roller 65.

The separation rubber pad 67 is made of NM-751 (NBR having rubber hardness of 75 and reinforced by nylon fibers) manufactured by SUMITOMO Rubber Company (in Japan) and has a thickness of 2 mm. The separation pad holder 68 is molded from polycarbonate including fluorine and is formed so that a surface of the holder to which the separation rubber pad 67 is bonded has a low central portion and high end portions without correcting camber after the molding. Accordingly, after the separation rubber pad 67 is bonded to the holder, the surface of the separation rubber pad 67 also has a low central portion and high end portions.

Since the camber having a high central portion and low end portions is apt to generated at the surface (to which the separation rubber pad 67 is bonded) of the separation pad holder 67 when the separation pad holder is molded due to the balance of configuration of the holder, the mold for molding the holder has a curved inner surface so that the camber having a low central portion and high end portions is generated on the surface to which the separation rubber pad 67 is bonded. It was found that the camber having the central portion lower than the end portions by about 0.1–0.1 mm gives good result.

Since the movement of the separation pad **30*b* toward the downstream side in the sheet supplying direction in the proximity of the downstream side of the MP separation roller 30*a* in its tangential direction is regulated by the projections 68*b* and the pad regulating ribs 73, the vibration of the separation pad 30*b* is suppressed during the drive rotation and idle rotation of the MP separation roller 30*a*. Further, since the surface of the separation rubber pad 67 has low central portion, the separation pad 30*b* is prevented to be flexed and vibrated in the tangential direction of the MP separation roller 30*a* during the drive rotation and idle rotation of the MP separation roller 30*a***.

If the separation rubber pad 67 has a high central portion, a surface pressure of the separation pad **30*b* is increased, with the result that the central portion of of the separation pad is subjected to a strong tangential force. In this case, since there is no projections 68*b* and no pad regulating ribs 73 at the central portion, the flexure of the pad cannot be suppressed, thereby causing the vibration of the pad. Further, if three or more pad regulating ribs 73 are provided, any play will occur due to the manufacturing dimensional error. When either the projections 68*b* or the pad regulating ribs 73** are flat, the same advantage can be obtained.

Since the axial length of the separation pad **30*b* is greater than the. length of the separation rubber roller 65, the recording sheet S passes through the nip between the separation pad and the separation rubber roller while being flexed toward the MP separation roller 30*a* as shown in FIG. 2. Thus, both side portions of the separation rubber pad 67 positioned outside of the separation rubber roller 65** are not worn by the recording sheet S so that the low central portion of the separation rubber pad can be maintained for a long time.

In the above-mentioned embodiment, the separation pad **30*b*** is made of, for example, BIE (butadiene isoprene EPMD) rubber having hardness of about 80°, urethane rubber including cork and having hardness of about 60° or natural rubber having hardness of about 70°. The separation rubber pad is made of, for example, silicone rubber having hardness of about 24° or EPDM rubber having hardness of about 25°.

Incidentally, the present invention is not limited to the above embodiment, various modification can be adopted within the scope of the present invention. For example, so long as the separation rubber pad 67 of the separation pad **30*b*** has the low central portion lower than the end portions, the surface of the separation rubber pad may be smoothly curved or be constituted by stepped surfaces.

Further, in the above-mentioned embodiment, while an example that the separation pad holder 68 is slidably supported by the frame via the bosses **68*a* and is urged against the separation roller 30*a* by the separation spring 72 was explained, the separation pad holder may be pivotally mounted on a shaft parallel to the separation roller 30*a*** and the separation pad may be attached to a free end portion of the separation pad holder so that the separation pad is urged against the separation roller by a separation spring.

Next, another embodiment of a separation pad **30*b*** will be explained.

Figure 7B:
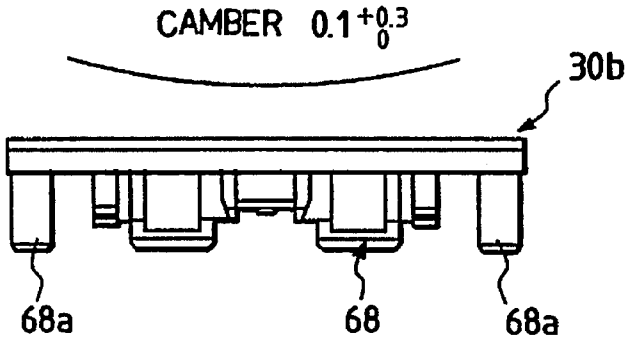
FIGS. 7A to 7D are views showing a separation pad according to a second embodiment of the present invention.
Figure 7D:
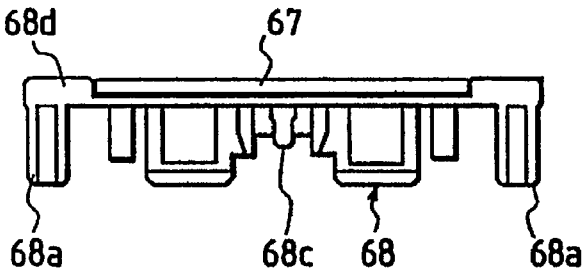
Figure 7A:
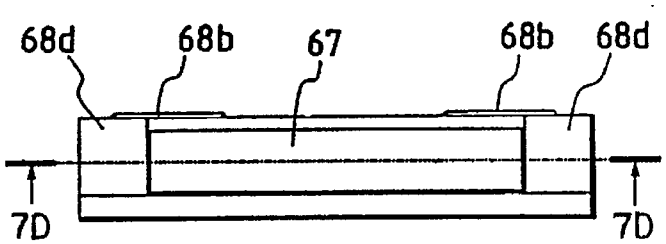
Figure 7C:
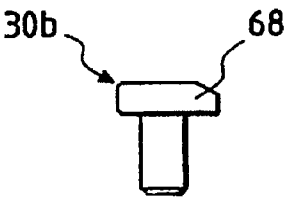

FIGS. 7A to 7D show a second embodiment of a separation pad **30*b*, where FIG. 7A is a plan view of the separation pad, FIG. 7B is a front view of the separation pad, FIG. 7C is a side view of the separation pad, and FIG. 7D is a sectional view taken along the line 7D—7D in FIG. 7**A.

In the separation pad **30*b*, the axial length of the separation rubber pad 67 is greater than the length of the separation rubber roller 65, and separation pad both end slide portions 68*d* are provided at both ends of the separation rubber pad. The separation pad both end slide portions 68*d* are protruded from the surface of the separation rubber pad 67 by 0.3±0.1 mm on contacting lines between a separation roller 60 and the slide portions (on the line 7D—7D). A gap of 0.5 mm is formed between each separation pad both end slide portion 68*d* and the separation rubber pad 67 to compensate the cutting error of the separation rubber pad 67. Further, the separation pad both end slide portions 68*d*** are chamfered by R to prevent the bending lines from being formed on the recording sheet S.

With this arrangement, the recording sheet S passes through the nip between the separation pad and the separation roller while being flexed toward the separation roller 60 as shown in FIG. 2. Thus, the surface of the separation pad **30*b* made of resin positioned outside of the separation rubber roller 65** is not worn by the recording sheet, with the result that the low central portion of the separation pad can be maintained for a long time.

Figure 8B:
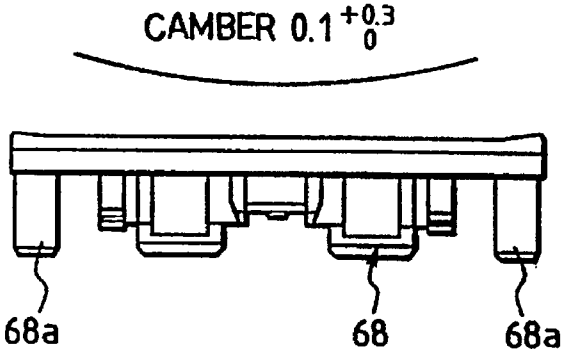
FIGS. 8A to 8D are views showing a separation pad according to a third embodiment of the present invention.
Figure 8D:
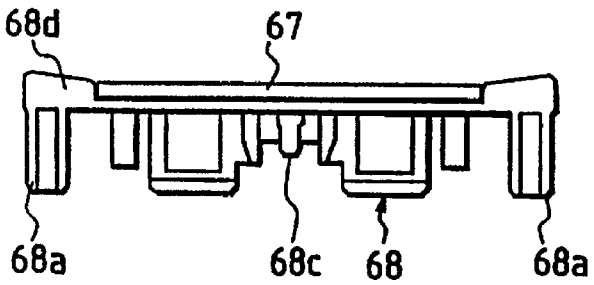
Figure 8A:
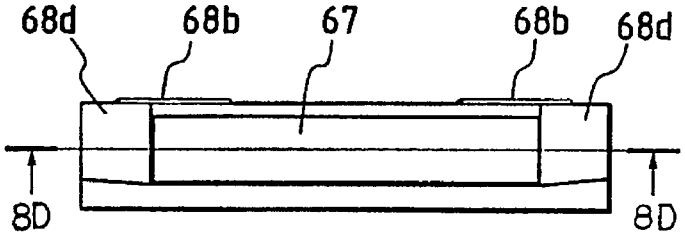
Figure 8C:
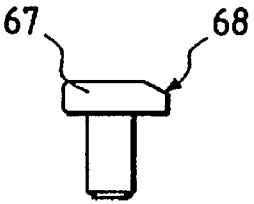

Next, a third embodiment of a separation pad **30*b* will be explained with reference to FIGS. 8A to 8D. FIG. 8A is a plan view of a separation pad 30*b* according to the third embodiment, FIG. 8B is a front view of the separation pad, FIG. 8C is a side view of the separation pad, and FIG. 8D is a sectional view taken along the line 8D—8D in FIG. 8**A.

FIGS. 8A to 8D correspond to FIGS. 7A to 7D showing the second embodiment. Portions other than the separation pad are same as those in the second embodiment.

The axial length of the separation rubber pad 67 is greater than the length of the separation rubber roller 65, and separation pad both end slide portions **68*d* are provided at both ends of the separation rubber pad. An end of each separation pad both end slide portion 68*d* near the separation rubber pad 67 is lower than the surface of the separation rubber pad 67 by 0.2±0.1 mm and an end of each separation pad both end slide portion 68*d* remote from the separation rubber pad 67 is higher than the surface of the separation rubber pad 7 by 0.7±0.1 mm, and both ends are connected by an inclined surface. With this arrangement, the recording sheet S does not contact with the inner ends of the separation pad both end slide portions 68*d***.

Figure 9B:
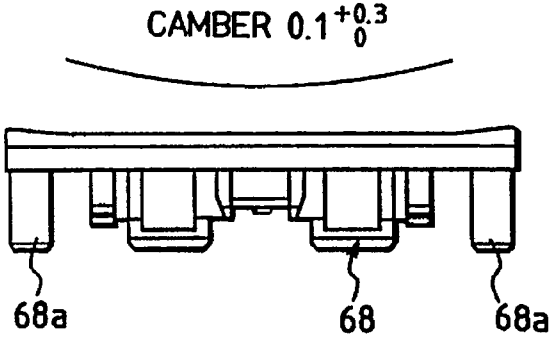
FIGS. 9A to 9D are views showing a separation pad according to a forth embodiment of the present invention.
Figure 9D:
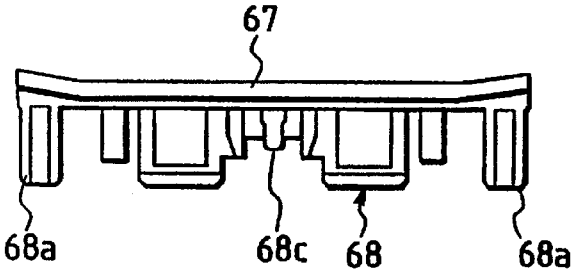
Figure 9A:
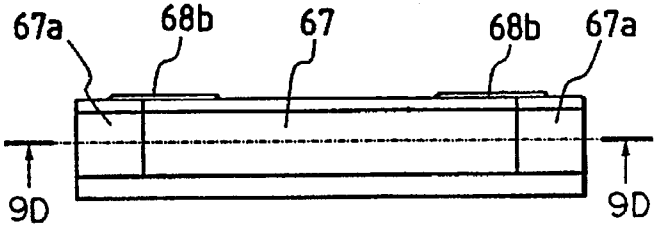
Figure 9C:
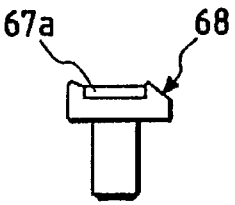

Next, a fourth embodiment of a separation pad 30*b* will be explained with reference to FIGS. 9A to 9D. FIG. 9A is a plan view of a separation pad 30*b* according to the fourth embodiment, FIG. 9B is a front view of the separation pad, FIG. 9C is a side view of the separation pad, and FIG. 9D is a sectional view taken along the line 9D—9D in FIG. 9A.

FIGS. 9A to 9D correspond to FIGS. 7A to 7D showing, the second embodiment. Portions other than the separation pad are same as those in the second embodiment.

A surface of the separation pad holder 58 to which the separation rubber pad 67 is bonded is inclined at outside of the separation rubber roller 65 so that each outer end of the surface becomes higher than each inner end by 0.7±0.1 mm. Thus, the separation rubber pad 67 bonded to the holder is also bend along the inclined surfaces so that both outer ends thereof becomes higher.

Further, an inlet side and an outlet side of the separation pad holder 68 become higher in correspondence to the above-mentioned inclination to prevent the recording sheet S from being caught by end faces of the separation rubber pad 67 when the sheet passes through the nip, thereby preventing the occurrence of the sheet jam.

Figure 10B:
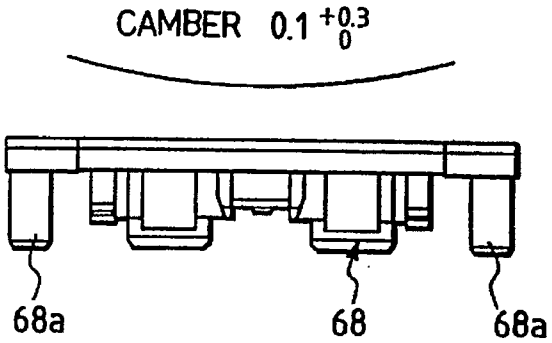
FIGS. 10A to 10D are views showing a separation pad according to a fifth embodiment of the present invention.
Figure 10D:
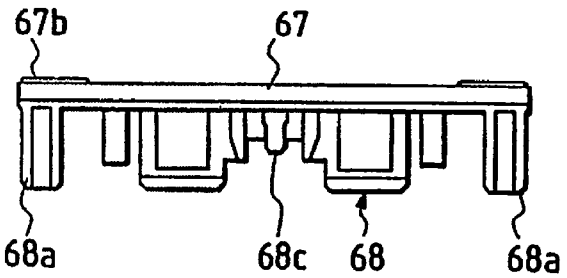
Figure 10A:
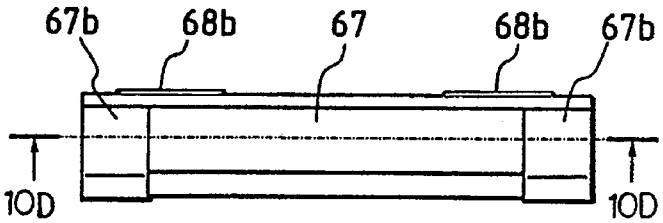
Figure 10C:
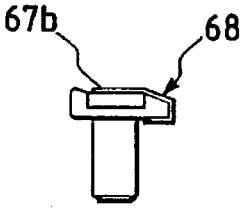

Next, a fifth embodiment of a separation pad 30*b* will be explained with reference to FIGS. 10A to 10D. FIG. 10A is a plan view of a separation pad 30*b* according to the fifth embodiment, FIG. 10B is a front view of the separation pad, FIG. 10C is a side view of the separation pad, and FIG. 10D is a sectional view taken along the line 10D—10D in FIG. 10A.

FIGS. 10A to 10D correspond to FIGS. 7A to 7D showing the second embodiment. Portions other than the separation pad are same as those in the second embodiment.

The axial length of the separation rubber pad 67 is greater than the length of the separation rubber roller 65, and separation pad both end slide portions 67*b* are provided on the separation rubber pad. Each separation pad both end slide portion 67*b* is formed from a SUS (stainless steel) plate having a thickness of 0.3 mm and is penetrated into the inlet side of the separation pad holder 68 to prevent the recording sheet S from being caught by the end faces of the separation pad both end slide portions 67*b*, thereby preventing the occurrence of the sheet jam. Further, the separation pad both end slide portions 67*b* are bonded to the separation pad holder 68 not to be dropped from the holder.

The separation pad both end slide portions 67*b* may be formed from other resin or metal plates such as a PET (polyethylene terepthalate) sheet.

Incidentally, in this embodiment, an amount of camber of the separation pad 30*b* may be 0.5–0.6 mm.

Further, in the above-mentioned embodiment, while an example that the separation pad holder 68 is slidably supported by the frame via the bosses 68*a* and is urged against the separation roller 30*a* by the separation spring 72 was explained, the separation pad holder may be pivotally mounted on a shaft parallel to the separation roller 30*a* and the separation pad 30*b* may be attached to a free end of the separation pad holder so that the separation pad is urged against the separation roller by a separation spring.

Incidentally, in the above-mentioned embodiments, while the facsimile system was explained as the image forming apparatus to which the sheet supply apparatus of the present invention is applied, the present invention may be applied to other image forming apparatuses such as a copying machine, printer and the like. Further, in the image forming apparatus, a heat-transfer recording method, an ink jet recording method or the like may be used, as well as the electrophotographic recording method.

Further, while an example that the present invention is applied to the sheet supply apparatus for supplying the sheet to the image forming apparatus was explained, the present invention may be applied to an original supplying portion for supplying an original to a reading portion for reading the original.

As mentioned above, according to the present invention, since the preventing means has the low central portion lower than the end portions, the contact pressure between the preventing means and supply rotary means is reduced at the central portion, with the result that the vibration between the sheet and the preventing means due to the movement of the sheet can be suppressed, thereby preventing the occurrence of noise. Further, since the central portion of the preventing means is merely lowered, the number of parts and manufacturing steps are not increased, thereby reducing the manufacturing cost.

Particularly, in the case where the plate-shaped friction member is attached to the holder member, since the attachment surface of the holder member is formed merely in such a manner that the central portion thereof becomes lower than the end portions, it can be manufactured in the similar manner to the conventional friction separation members (separation pad). That is to say, since the preventing means can be obtained merely by attaching the cheap plate-shaped friction member to the holder member, the manufacture of the preventing means is simple and inexpensive.

By providing the regulating means for regulating the shifting movement of the preventing means toward the sheet supplying direction, the vibration generated between the sheet and the preventing means in the sheet supplying direction can surely be suppressed. Further, by providing the regulating means at both ends of the preventing means, the positional accuracy of the preventing means is ensured, thereby improving the sheet separating ability. Since the length of the preventing means is greater than the length of the supply rotary member, the sheet is always flexed in a convex shape directing toward the preventing means, with the result that the both axial end portions of the preventing means are not worn, and, thus, the low central portion of the preventing means is maintained for a long time, thereby surely preventing the occurrence of noise for a long time.

In the case where the extension portions of the preventing means are gradually inclined so that the outermost ends become highest, the sheet can surely be flexed in the convex shape. Further, in the case where the plate-shaped member are provided on the extension portions, since the flexed amount of the sheet can be adjusted in accordance with the sheet to be prevented, the noise can surely be suppressed.

What is claimed is:

1. A sheet supply apparatus comprising:

a sheet supporting means for supporting sheets;

a supply rotary member for feeding out the sheets supported on said sheet supporting means; and preventing means biased toward said supply rotary member for preventing double feed of sheets fed by said supply rotary member;

wherein a preventing surface of said preventing means has extension portions at both sides of a central portion, each extension portion extending beyond an end of said supply rotary member in an axial direction thereof, said extension portions protruding more than the central portion toward the outer ends of said supply rotary member.

2. A sheet supply apparatus according to claim 1, wherein said supply rotary member has large diameter portions spaced apart from each other by a predetermined distance and disposed at left and right sides regarding a central portion of said preventing means, and a small diameter portion spaced apart from said preventing means in a confronting relation to said central portion of said preventing means.

3. A sheet supply apparatus according to claim 2, further comprising urge means for urging said preventing means toward said supply rotary member, said urge means urging said central portion of said preventing means.

4. A sheet supply apparatus according to claim 2 wherein the preventing surface of said preventing means extends up, to outside of said large diameter portions of said supply rotary member.

5. A sheet supply apparatus according to claim 2, wherein said preventing means is mounted on a body of the apparatus for shifting movement to be contacted with said supply rotary member, and a regulating means for regulating a shifting movement of said preventing means toward a sheet supplying direction is provided between said preventing means and the body of the apparatus.

6. A sheet supply apparatus according to claim 5, wherein said regulating means is provided on either said preventing means or the body of the apparatus and comprises rib-shaped projections positioned at positions corresponding to the proximity of both ends of said preventing means in an axial direction of said supply rotary member.

7. A sheet supply apparatus comprising:

a sheet supporting means for supporting sheets;

a supply rotary member for feeding out the sheets supported on said sheet supporting means; and a preventing means biased toward said supply rotary member for preventing a double-feed of sheets fed by said supply rotary member;

wherein a preventing surface of said preventing means includes side edges and is concavedly curved so that said side edges are configured in an axial direction of said supply rotary member and are higher than a central portion of said preventing surface.

8. A sheet supply apparatus according to claim 7, wherein said preventing means is constituted by attaching a flat plate-shaped friction member to a holder member, and an attachment surface of said holder member to which said friction member is attached has a curved configuration having a lower central portion and high end portions along an axial direction of said supply rotary member, thereby obtaining a low central portion of said friction member.

9. A sheet supply apparatus according to claim 8, wherein said supply rotary member has large diameter portions spaced apart from each other by a predetermined distance and disposed at left and right sides regarding a central portion of said preventing means, and a small diameter portion spaced apart from said preventing means in a confronting relation to said central portion of said preventing means.

10. A sheet supply apparatus according to claim 9, wherein the preventing surface of said preventing means extends up, to outside of said large diameter portions of said supply rotary member.

11. A sheet supply apparatus comprising:

a sheet supporting means for supporting sheets;

a supply rotary member for feeding out the sheets supported on said sheet supporting means; and a preventing means biased toward said supply rotary member for preventing a double-feed of sheets fed by said supply rotary member;

wherein said preventing means has a central surface and side extension portions each extension portion extending beyond an end of said supply rotary member in an axial direction of said supply rotary member, said extension portions become higher than said central surface toward the outer ends of said supply rotary member.

12. A sheet supply apparatus according to claim 11, wherein said preventing means is constituted by attaching a flat plate-shaped friction member to a holder member, and said holder member is extended toward the axial direction of said supply rotary member to form said extension portions.

13. A sheet supply apparatus according to claim 11, wherein said preventing means is constituted by attaching a flat plate-shaped friction member to a holder member, and said friction member is extended toward the axial direction of said supply rotary member and a thickness of said preventing surface corresponding to the extended portions of said friction member is increased to form said extension portions.

14. A sheet supply apparatus according to claim 11, wherein said preventing means is constituted by attaching a flat plate-shaped friction member to a holder member, and an attachment surface of said holder member to which said friction member is attached has curved portions which are positioned outside of said supply rotary member and which become gradually higher toward said supply rotary member, thereby forming said extension portions by flexing said friction member by said curved portions.

15. A sheet supply apparatus according to claim 11, wherein said preventing means is constituted by attaching a flat plate-shaped friction member to a holder member, and plate-shaped member each having a predetermined thickness are attached to said friction member outside of said supply rotary member to form said extension portions.

16. A sheet supply apparatus according to claim 15, wherein said plate-shaped members are formed from SUS plates.

17. A sheet supply apparatus according to claim 15, wherein said plate-shaped members are formed from PET sheets.

18. A sheet supply apparatus according to claim 11, wherein said extension portions each has an inclined surface which becomes gradually higher toward its outer end.

19. A sheet supply apparatus according to claim 11, wherein said supply rotary member has large diameter portions spaced apart from each other by a predetermined distance and disposed at left and right sides regarding a central portion of said preventing means, and a small diameter portion spaced apart from said preventing means in a confronting relation to said central portion of said preventing means.

20. A sheet supply apparatus comprising:

a sheet supporting means for supporting sheets;

a supply rotary member for feeding out the sheets supported on said sheet supporting means and a preventing means biased toward said supply rotary member for preventing a double feed of sheets fed by said supply rotary member;

wherein the sheet nipped between said preventing means and said supply rotary member is flexed in a convex shape so that a central contact portion of the sheet contacted to said supply rotary member is lower than side edges of the sheet towards outer ends of said supply rotary member.

21. A sheet supply apparatus according to claim 20, wherein said supply rotary member has large diameter portions spaced apart from each other by a predetermined distance and disposed at left and right sides regarding a central portion of said preventing means, and a small diameter portion spaced apart from said preventing means in a confronting relation to said central portion of said preventing means.

22. An image forming apparatus comprising:

a sheet supporting means for supporting sheets;

a supply rotary member for feeding out the sheets supported on said sheet supporting means; and image forming means for forming an image on a sheet fed out by said supply rotary member;

preventing means biased toward said supply rotary member for preventing double-feed of sheets fed by said supply rotary member;

wherein a preventing surface of said preventing means has extension portions at both sides of a central portion, each extending beyond an end of said supply rotary member in an axial direction thereof said extension portions protruding more than the central portion toward said supply rotary member.

23. An image forming apparatus comprising:

a sheet supporting means for supporting sheets;

a supply rotary member for feeding out the sheets supported on said sheet supporting means;

a preventing means biased toward said supply rotary member for preventing a double-feed of sheets fed by said supply rotary member; and image forming means for forming an image on a sheet fed out by said supply rotary member;

wherein a preventing surface of said preventing means includes side edges and is concavedly curved so that said side edges are configured in an axial direction of said supply rotary member and are higher than a central portion of said preventing surface.

24. An image forming apparatus comprising:

a sheet supporting means for supporting sheets;

a supply rotary member for feeding out the sheets supported on said sheet supporting means;

a preventing means biased toward said supply rotary member for preventing a double-feed of sheets fed by said supply rotary member; and image forming means for forming and image on a sheet fed out by said supply rotary member;

wherein said preventing means has a central surface and side extension portions each extension portion extending beyond an end of said supply rotary member in an axial direction of said supply rotary member, said extension portions become higher than said central surface toward the outer ends of said supply rotary member.

25. An image forming apparatus comprising:

a sheet supporting means for supporting sheets;

a supply rotary member for feeding out the sheets supported on said sheet supporting means; and a preventing means biased toward said supply rotary member for preventing a double-feed of sheets fed by said supply rotary member; and image forming means for forming an image on a sheet fed out by said supply rotary member;

wherein the sheet nipped between said preventing means and said supply rotary member is flexed in a convex shape so that a central conctact portion of the sheet contacted to said supply rotary member is lower than side edges of the sheet towards outer edges of said supply rotary member.

* * * * *

UNITED STATES PATENT AND TRADEMARK OFFICE

CERTIFICATE OF CORRECTION

PATENT NO. : 5,653,433
DATED : August 5, 1997
INVENTOR(S) : Haruo ISHIZUKA

It is certified that error appears in the above-identified patent and that said Letters Patent is hereby corrected as shown below:

Title Page, [56], delete "Chasi" and insert therefor --Ohashi--.

Column 3, line 18, delete "5burged" and insert therefor --5b urged--.

Column 5, line 23, delete "mountin" and insert therefor --mounting--;
Line 36, delete "10".

Column 9, line 15, delete "bend" and insert therefor --bent--.

Column 11, line 12, after "2", insert a comma (",").

Column 12, line 55, after "means", insert a semicolon (";").

Column 13, line 20, after "thereof", insert a comma (",").

Column 14, line 9, delete "and" and insert therefor --an--;
Line 31, delete "conctact" and insert therefor --contact--.

Signed and Sealed this

Twelfth Day of May, 1998

Bruce Lehman

*Attest:*

BRUCE LEHMAN

*Attesting Officer*

*Commissioner of Patents and Trademarks*